US009234523B2

(12) United States Patent
Henning

(10) Patent No.: US 9,234,523 B2
(45) Date of Patent: Jan. 12, 2016

(54) SUBMERSIBLE PUMP

(75) Inventor: Poul Johannes Henning, Tjele (DK)

(73) Assignee: Grundfos Management a/s, Bjerringbro (DK)

( * ) Notice: Subject to any disclaimer, the term of this patent is extended or adjusted under 35 U.S.C. 154(b) by 819 days.

(21) Appl. No.: 13/519,983

(22) PCT Filed: Nov. 23, 2010

(86) PCT No.: PCT/EP2010/007100
§ 371 (c)(1),
(2), (4) Date: Dec. 3, 2012

(87) PCT Pub. No.: WO2011/079892
PCT Pub. Date: Jul. 7, 2011

(65) Prior Publication Data

US 2013/0089420 A1 Apr. 11, 2013

(30) Foreign Application Priority Data

Dec. 30, 2009 (EP) ..... 09016147

(51) Int. Cl.

| | |
|---|---|
| ***F04D 5/00*** | (2006.01) |
| ***F04D 29/12*** | (2006.01) |
| ***F04D 7/04*** | (2006.01) |
| ***F04D 13/08*** | (2006.01) |

(52) U.S. Cl.
CPC ..... *F04D 29/126* (2013.01); *F04D 7/04* (2013.01); *F04D 13/086* (2013.01); *F05B 2260/603* (2013.01); *F05B 2260/63* (2013.01)

(58) Field of Classification Search
CPC ..... F04D 7/02; F04D 7/04; F04D 7/045; F04D 29/086; F04D 29/2261; F04D 29/2266; F04D 29/2288; F04D 29/2294
USPC ..... 415/174.3
See application file for complete search history.

(56) References Cited

U.S. PATENT DOCUMENTS 3,881,840 A * 5/1975 Bunjes ..... 415/109
5,984,629 A 11/1999 Brodersen et al.

FOREIGN PATENT DOCUMENTS

| | | | |
|---|---|---|---|
| EP | 0538212 | A1 | 4/1993 |
| EP | 1 300 594 | B1 | 10/2009 |
| GB | 2 310 252 | A | 8/1997 |
| WO | 2005/038260 | A1 | 4/2005 |
| WO | 2005/050024 | A1 | 6/2005 |

* cited by examiner

*Primary Examiner* — Edward Look
*Assistant Examiner* — Jason Mikus
(74) *Attorney, Agent, or Firm* — McGlew and Tuttle, P.C.

(57) ABSTRACT

A submersible pump includes an impeller (8) arranged in a pump housing (2). A seal (22) seals the impeller (8) with respect to a stationary part of the pump housing (2). The seal (22) includes a sealing ring (24) arranged on the impeller side. The sealing ring engages in a second sealing ring (26) arranged on the pump housing side. The sealing ring (26) on the pump housing side has at least one hole (28) for discharging solid particles from the impeller (8).

20 Claims, 5 Drawing Sheets

SUBMERSIBLE PUMP

CROSS REFERENCE TO RELATED APPLICATIONS

This application is a U.S. National Phase application of International Application PCT/EP2010/007100 which claims the benefit of priority under 35 U.S.C. §119 of European Patent Application EP 09016147.2 filed Dec. 30, 2009, the entire contents of which are incorporated herein by reference.

FIELD OF THE INVENTION

The invention relates to a submersible pump.

BACKGROUND OF THE INVENTION

It is common to apply submersible pumps for pumping away waste water containing solid matter. These pumps as a rule are provided with a single-channel or multi-channel impeller for delivering waste water. Such a submersible pump is known for example from EP 1 300 594 B1. The pump described there, on the entry side of its impeller in the region of the suction port comprises a cutting device which fragments or reduces the size of the solid matter contained in the waste water to be delivered, in order to prevent a blockage of the pump impeller. As a rule, the waste water delivery with this pump has been found to be unproblematic. However, the fragmented solid matter constituents as well as the air sucked by the pump can penetrate into the comparatively large cavity of the impeller and thus lead to vibrations and flow noise resulting therefrom. Such cavities with single-channel impellers result on the rear side of the flow channel in the inside of the impeller and are usually open to the axial end of the impeller which is away from the suction port. The solid particles located in the cavity of the impeller also represent a problem with regard to the shaft seal which seals the pump housing with respect to the drive shaft of the impeller which is led into the pump housing, since if these solid particles get into the shaft seal, they can negatively influence its functional characteristics and cooling as the case may be.

SUMMARY OF THE INVENTION

Against this background, it is the object of the invention to provide an improved pump of the type mentioned above, with which impeller oscillations and a noise formation entailed by these are at least reduced and preferably prevented, and with which the shaft seal sealing the pump housing is protected from solid particles located in the impeller.

The submersible pump according to the invention comprises an impeller arranged in a pump housing, in particular a single-channel impeller with a cavity in the inside. The impeller can however have all impeller shapes which are common with submersible pumps. The submersible pump is provided with a seal which seals the impeller with respect to a stationary part of the pump housing. This seal in particular prevents a penetration of solid mater and contamination into at least one cavity situated in the inside of the impeller, outside a flow channel. This seal comprises a sealing ring which is arranged on the impeller side and which engages into a second outer sealing ring arranged on the pump housing side. The impeller-side sealing ring is fixedly connected to the impeller and accordingly co-rotates with the rotating impeller. The sealing ring arranged on the pump housing side is fixed in the pump housing in a rotationally fixed manner. Together, the two applied sealing rings form a radial seal which is preferably arranged in the region of the outer periphery of the impeller and seals the impeller and in particular its cavity, with respect to the interior of the pump housing, through which interior fluid flows.

The invention is based on the idea of leading away solid matter particles which are located inside the impeller, i.e. in a cavity of the impeller or air collecting there, via the seal into a region outside the impeller. For this purpose, the sealing ring on the pump housing side, which is to say the pump-housing-side seal, according to the invention comprises at least one recess for leading away solid particles. Preferably, only one recess is formed on this sealing ring, in order to influence the basic sealing characteristics of the seal as little as possible, but this sealing ring can however also comprise several recesses. In order to be able to lead the solid matter particles via the seal into a region outside the impeller, the gap located between the sealing ring arranged on the impeller side and the pump-housing-side sealing ring essentially bearing on this, is usefully dimensioned and/or designed in a manner such that solid matter particles can penetrate into this gap and then at the recess formed on the outer sealing ring arranged on the pump housing side can exit out of the seal into the cavity of the pump housing which is adjacent thereto and through which fluid flows. Further advantageously, the gap has a design and dimensioning which on the one hand permits air to be led away out of the inside of the impeller via the gap, but on the other hand can prevent a penetration of solid matter into the cavity of the impeller.

By way of moving solid matter particles and air which are located in the inside of the impeller, i.e. in a cavity, via the seal out of the impeller into a pump housing section surrounding the impeller, these can no longer influence the smoothness of the running of the impeller. Moreover, by way of the reduction of the solid matter share in the fluid, one reduces the danger of solid patter particles being able to penetrate into a shaft seal which is usually provided for the fluid-tight feed-through of the drive shaft of the impeller into the pump housing.

The impeller-side sealing ring on its outer side comprises at least one catcher for the transport of solid matter particles, in order to be able to lead the solid particles located in the gap between the impeller-side sealing ring and the pump-housing-side sealing ring, through the seal and in this context advantageously to the recess formed on the outer sealing ring. Such catchers can for example be produced via a relief-like topography of the outer periphery surface of the impeller-side sealing ring, with which projections and/or depressions entrain or catch solid matter particles located in the sealing gap, with the rotation of the impeller-side sealing ring, and move them to the recess which is formed on the pump-housing-side sealing ring, where they are released to the environment of the seal.

With regard to the submersible pump according to the invention, it is preferably the case of a pump set up vertically, with which the suction region is arranged in the region of a lower end of the pump below a vertically mounted impeller. With these pumps, air which as the case may be is co-sucked by the submersible pump can collect in an upper impeller region in particular in a cavity of the impeller. Inasmuch as this is concerned, it has been found to be useful to arrange the seal sealing the impeller with respect to a stationary part of the pump housing exactly in this upper region of the impeller, so that the air located in the impeller can escape via the seal directly out of the impeller. Thus one advantageous further formation of the submersible pump according to the invention envisages arranging the seal sealing the impeller or its cavity with respect to a stationary part of the pump housing at an end of the impeller which axially distanced to the suction port of the pump.

According to a further advantageous further formation, the seal arranged on the impeller side as well as the seal arranged on the pump housing side can have a hollow-cylindrical shape. Accordingly, in each case sealing rings with a sleeve shape can be applied as sealing rings. Hereby, the sealing ring on the pump housing side can overlap the sealing ring attached on the impeller at the outer side or peripheral side of this, in a comparatively large region in the axial direction, by which means correspondingly good sealing characteristics can be realized. I.e. the one sealing ring, preferably the sealing ring on the pump housing side, peripherally surrounds the other sealing ring.

As has already been noted, a catcher formed on the outer side or peripheral side of the impeller-side sealing ring, or several catchers provided there for the transport of solid-matter particles can be formed by a relief-like surface structure formed on the outer lateral surface of this sealing ring. In the context, it is preferably for the impeller-side sealing ring on its outer periphery to comprise at least one depression. Particularly advantageously, several depressions are formed distributed uniformly around the periphery of the sealing ring. The use of trough-like depressions for the transport of solid matter particles is advantageous inasmuch as this design of the catchers has no influence on the remaining gap width between the impeller-side sealing ring and the sealing ring on the pump housing side, since no radially outwardly projecting prominences are required on the impeller-side sealing ring. Accordingly, the gap can be otherwise dimensioned in a small manner.

The depressions formed on the impeller-side sealing ring serve for receiving solid matter particles. It has been found to be particularly useful if the recess formed on the pump-housing-side sealing ring is arranged and designed in a manner such that it completely exposes a depression of the impeller-side sealing ring, in order to be able to transport these solid matter particles out of the seal. I.e. when the depression of the impeller-side sealing ring is located at the same angular position as the recess, the recess and depression lie over one another. Accordingly, a design is envisaged, with which by way of rotation of the impeller-side sealing ring relative to the sealing ring on the pump housing side, the depression or depressions formed on the impeller-side sealing ring are moved into a position, in which they are not covered by this sealing ring, on account of the recess formed on the pump-housing-side sealing ring. Solid matter particles located in a depression can then fall out of the depression at this location, into the pump housing.

The recess formed on the pump-housing-side sealing ring is usefully arranged in a region of the pump housing, through which fluid flows and which is flow-connected to the pressure connection of the pump, for transporting solid matter particles away out of the pump housing. Hereby, one preferably envisages the recess being arranged on a section of the sealing ring which faces a low-pressure region of the pump housing. In this context, a low-pressure region of the pump housing is to be understood as such a region in the outflow elbow of the pump housing, through which region fluid flows and in which a lower fluid pressure prevails that at the pressure connection, i.e. the exit cross section of the pump.

The recess formed on the pump-housing-side sealing ring is preferably formed on an axial outer edge of the sealing ring. Typically, with regard to this outer edge of the sealing ring, it is the case of the edge which is arranged facing the impeller of the pump. The recess is thus preferably arranged in the region of the pump-housing-side sealing ring which is distanced furthest from the free end of the impeller-side sealing ring engaging therein.

Particularly advantageously, an edge delimiting the recess can at least in sections form a cutter. I.e., at least one edge section, for example by way of a suitable grinding, has a tapering geometry such that it gives this edge section a certain sharpness. This sharpened edge region serves for fragmenting the solid matter particles transported through the seal to the recess of the pump-housing-side sealing ring, before release into the pump housing.

Usefully, the cutter or cutting edge formed on the edge delimiting the recess is formed on an edge section of the recess which faces the rotation direction of the impeller. This makes sense inasmuch as the solid matter particles transported by the sealing ring fastened on the impeller with a rotation of this, are moved directly to the cutter, i.e. its cutting edge in the cutting direction.

Preferably, the section forming the cutter is aligned at an angle of 15-90° with respect to the outer end-side of the sealing ring. Particularly advantageously, the angle which the cutter forms with the outer end-side of the pump-housing-side sealing ring is larger than 35°, since it has been found that with smaller angles there is the danger that solid matter particles led to the cutter can settle on the cutter without being cut as is desired.

An edge section of the recess which is arranged lying opposite the cutter can also be chamfered with respect to the outer end-side of the sealing ring, so that the recess can have an essentially wedge-like or trapezoidal outer contour. Hereby, the edge section which is arranged lying opposite the cutter can advantageously likewise be aligned at an angle of 15-90° with respect to the outer end-side of the sealing ring, wherein however one preferably envisages this angle being larger than the angle between the cutter and the outer end-side of the sealing ring.

The invention is hereinafter explained in more detail by way of an embodiment example represented in the drawings. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
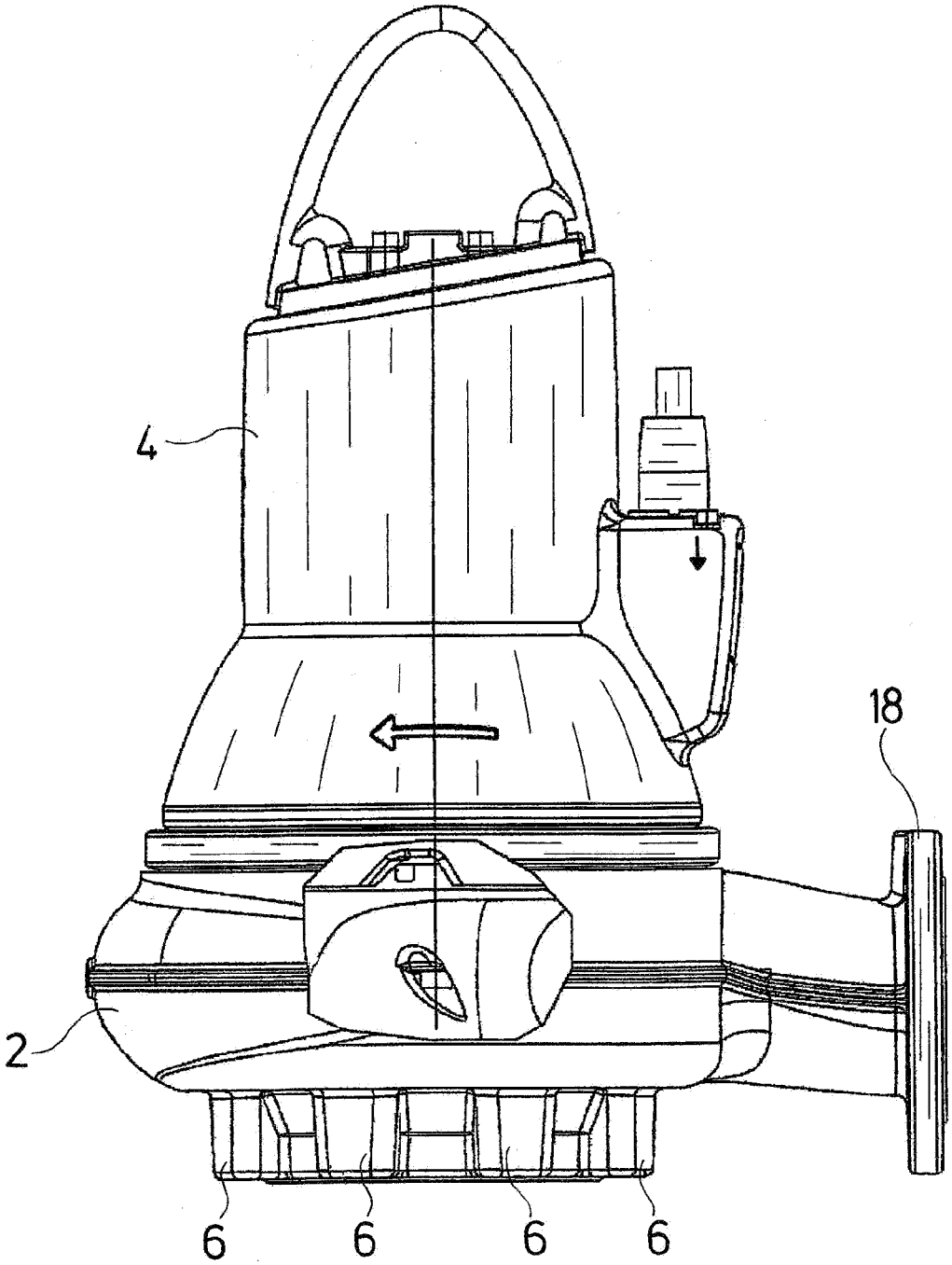
FIG. 1 is a lateral view of a submersible pump according to the invention.
Figure 2:
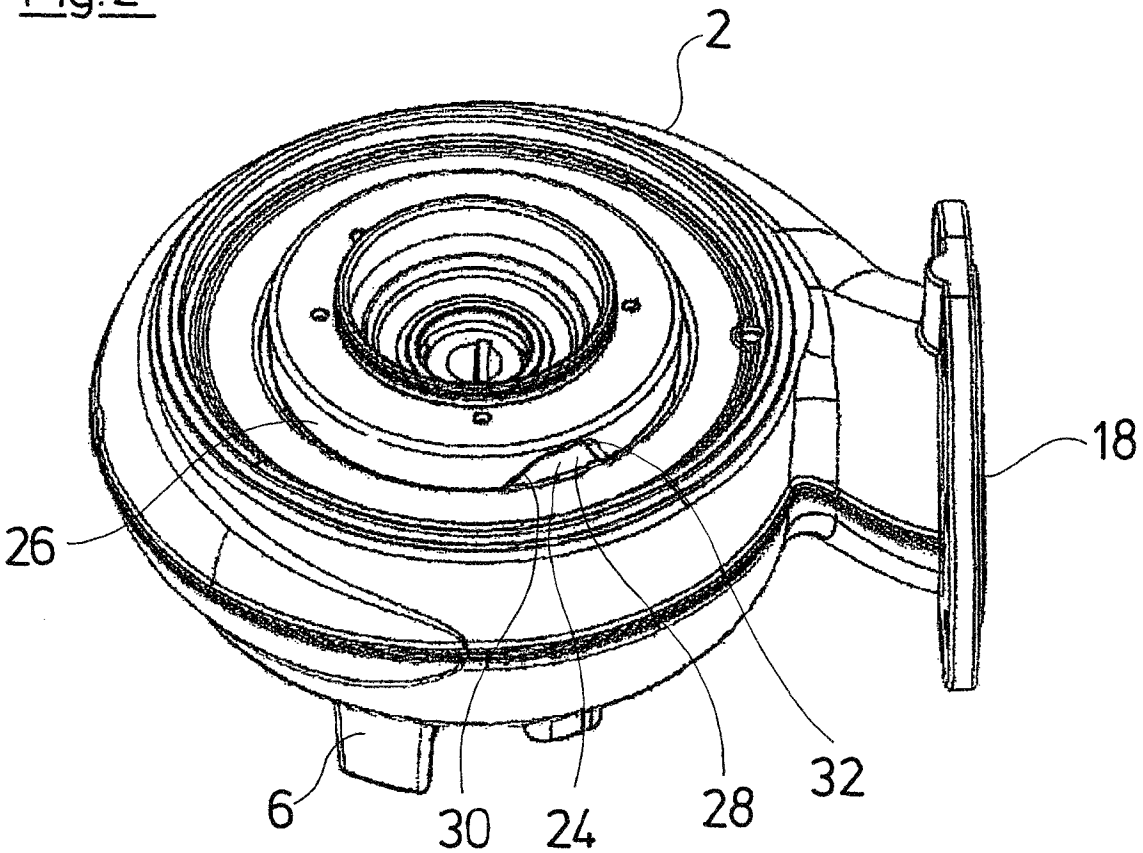
FIG. 2 is a perspective view of a pump housing of the submersible pump according to FIG. 1.
Figure 3:
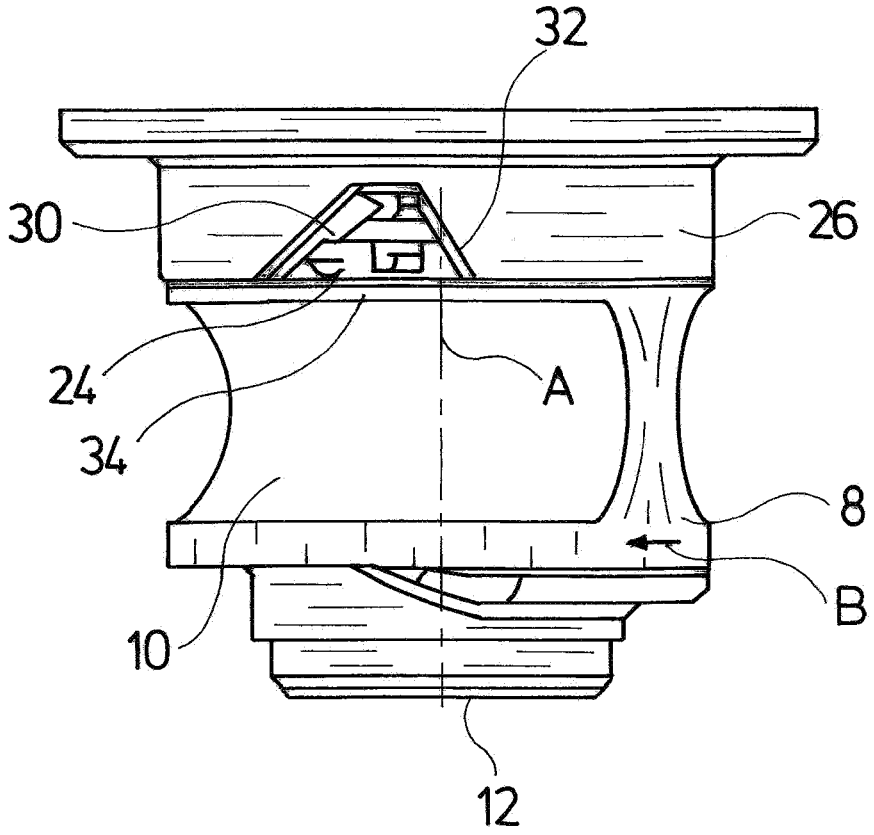
FIG. 3 is a lateral view showing an impeller of the submersible pump according to FIG. 1.

Referring to the drawings in particular, with the submersible pump represented in FIG. 1, it is the case of a submersible pump to be set up vertically. This submersible pump in the usual manner has a two-part housing with a pump housing 2 and a motor housing 4 which is arranged above the pump housing 2. Several stand feet 6 of the submersible pump which encircle a suction region of the submersible pump are arranged annularly on the lower end of the pump housing 2.

Figure 5:
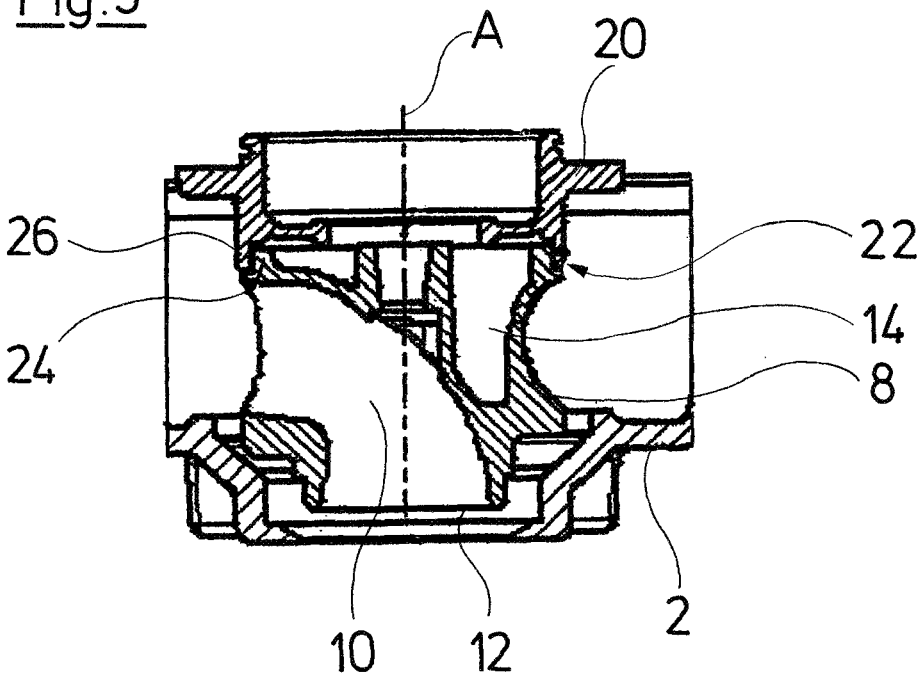
FIG. 5 is a longitudinal sectional view showing a section of the pump housing according to FIG. 2.
Figure 6:
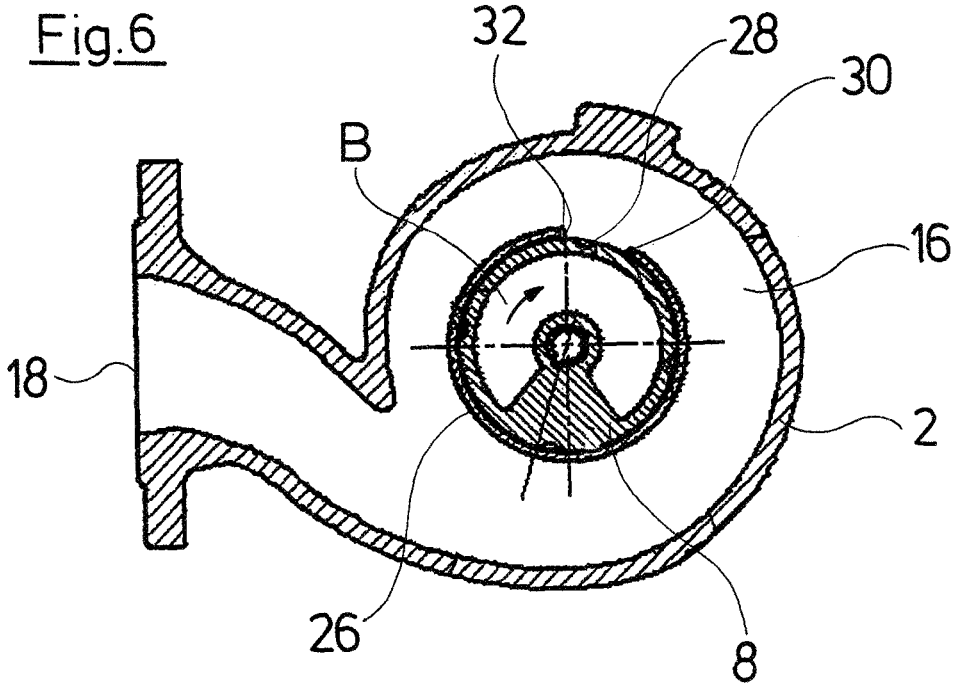
FIG. 6 is a schematic cross sectional view of the pump housing according to FIG. 2.

An impeller 8 is rotatably mounted (FIG. 5) about a longitudinal axis A of the pump housing 2 in a rotation direction B, in the pump housing 2. With regard to the impeller 8 it is the case of a so-called single-channel impeller with an impeller channel 10 which extends from a suction port 12 situated at an axial end of the impeller 8, to the periphery of the impeller. On the rear side of the impeller channel 10, i.e. separated from this, a cavity or hollow 14 is formed in the inside of the impeller 8 and is open to the axial side of the impeller 8 which is away from the suction port 12. A fluid-leading outflow elbow 16 which runs out in a pressure connection 18 of the pump housing 2 is formed (FIG. 6) radially outside the impeller 8, in the pump housing 2.

The impeller 8 by way of a seal 22 is sealed in the pump housing 2 with respect to a component 20 which is stationary there. The seal 22 is formed by a sealing ring 24 formed on the impeller 8 and by a sealing ring 26 formed on the component 20, wherein the impeller-side sealing ring 24 engages into the sealing ring 26 formed on the component 20. The sealing ring 24 is arranged on the end-side end of the impeller 8 which is away from the suction port 12, whilst the sealing ring 26 is arranged on the component 20 of the pump housing at a side facing the impeller 8. Both sealing rings 24 and 26 are designed in an essentially hollow-cylindrical manner and are arranged concentrically to one another.

Figure 4:
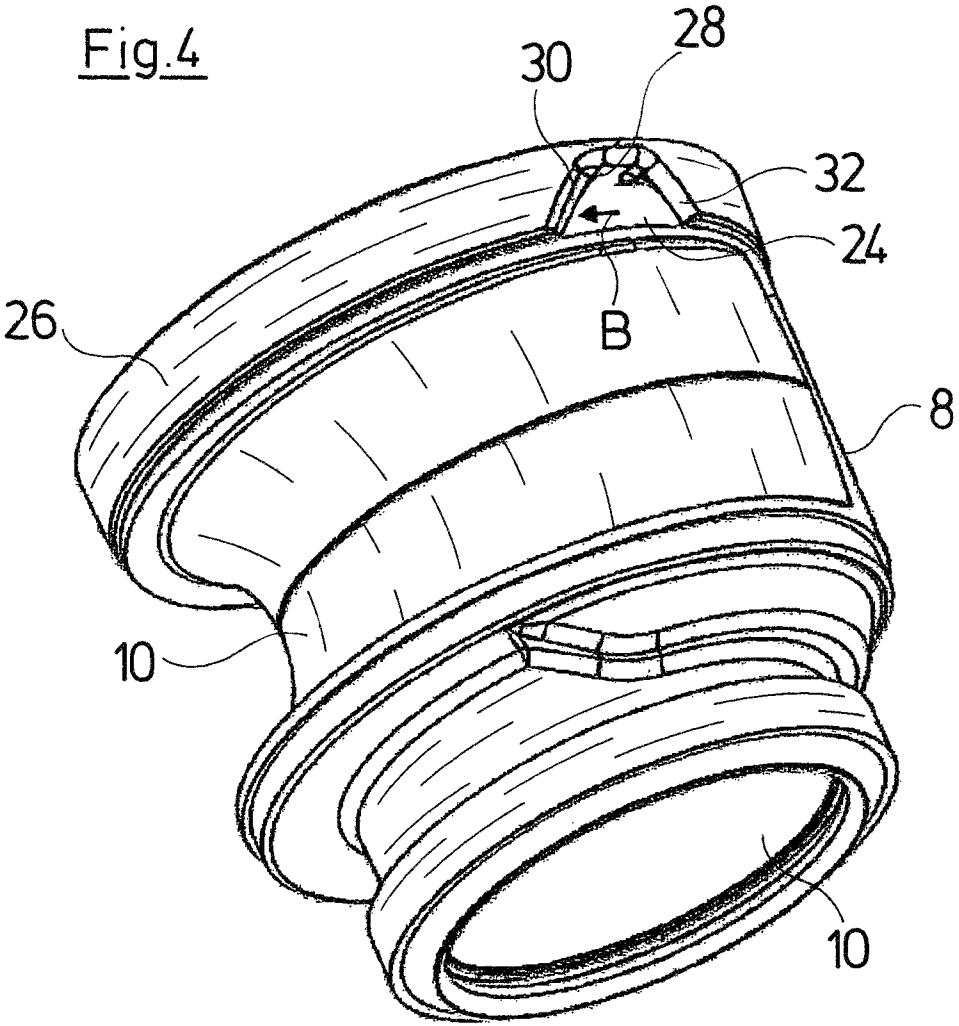
FIG. 4 is a perspective view of the impeller according to FIG. 3 with a pump-housing-side sealing ring which is arranged thereon.

A recess 28 is formed on the sealing ring 26, at which recess the impeller-side sealing 24 otherwise encased by the sealing ring 26 is exposed. The recess 28 in its angular position with respect to the longitudinal axis A is arranged in a low-pressure region of the outlet elbow 16 which is distanced to the pressure connection 18 (FIG. 6), and departing from an end-side of the sealing ring 26 which faces the impeller 8 extends in the direction of the component 20, wherein the width of the recess 28 tapers trapezoidally in the direction of the component 20. For this, the side edges 30 and 32 of the recess 28 which are adjacent the end-side of the sealing ring 26 and lie opposite one another, are beveled in each case with respect to the end-side of the sealing ring 28. Hereby, the side edge 30 facing the rotation direction B of the impeller 8 is angled at an angle of roughly 45° with respect to the end-side of the sealing ring 26, and the side edge 32 lying opposite the side edge 30 is angled at an angle of roughly 60° with respect to the end-side of the sealing ring 26. As is particularly clear from FIG. 4, the wall thickness of the sealing ring 26 tapers continuously in the region of the side-edge 30 and thus forms a cutter 30 whose function will be explained hereinafter.

Four trough-like depressions 34 are formed on the outer peripheral surface of the impeller-side sealing ring 24, in a manner departing from the end-side end of the sealing ring 24. One or more of the depressions 24 form at least one catcher. These depressions 34 are uniformly distributed over the periphery of the sealing ring 24 in a manner distanced to one another. The depressions 34 together with the recess 28 formed on the sealing ring 26 serve for leading away solid matter particles which as the case may be are located in the cavity 14 of the impeller 8 and which could otherwise lead to undesired impeller vibrations and thus noise which these entail, via the seal 22 into the outflow elbow 16. Hereby, the depressions 34 are provided for receiving these solid matter particles. Moreover, the depressions 34 serve for the transport of the solid matter particles to the recess 28 of the sealing ring 26 where the recesses 34 are no longer covered by the sealing ring 26, so that solid matter particles located in the depressions 34 can be let out into the low-pressure region of the outflow elbow 16 which is adjacent the recess 28. Solid matter particles, for example solid matter fibres, which project out of the depressions 34 in the region of the recess 28 by way of the impeller rotation are pressed against the cutter 30 and are fragmented in this manner.

While specific embodiments of the invention have been shown and described in detail to illustrate the application of the principles of the invention, it will be understood that the invention may be embodied otherwise without departing from such principles.

The invention claimed is:

1. A submersible pump comprising:

a pump housing;

an impeller arranged in the pump housing; and a seal which seals the impeller with respect to a stationary part of the pump housing, wherein the seal comprises an impeller side sealing ring which is arranged on the impeller side and which engages into a pump-housing-side sealing ring arranged on the pump housing side, wherein the pump-housing-side sealing ring comprises at least one recess for leading away solid matter particles and the impeller-side sealing ring on an outer side thereof comprises at least one catcher for the transport of solid matter particles.

2. A submersible pump according to claim 1, wherein the seal is arranged at an end of the impeller which is axially distanced to a suction port of the pump.

3. A submersible pump according to claim 1, wherein the impeller-side sealing ring arranged on the impeller side as well as the pump-housing-side sealing ring arranged on the pump housing side have a hollow-cylindrical shape.

4. A submersible pump according to claim 1, wherein the impeller-side sealing ring on an outer periphery thereof comprises at least one depression, said at least one depression forming said at least one catcher.

5. A submersible pump according to claim 4, wherein the recess of the pump-housing-side sealing ring is arranged and designed such that it completely releases the at least one depression of the impeller-side sealing ring, said depression being defined by a circumferential surface of said impeller-side sealing ring, said circumferential surface extending continuously, with interruption, wherein said depression is open on only one side thereof.

6. A submersible pump according to claim 1, wherein the recess is arranged on a section of the sealing ring which faces a low-pressure region of the pump housing.

7. A submersible pump according to claim 1, wherein the recess is formed on an axial outer edge of the sealing ring.

8. A submersible pump according to claim 1, wherein an edge delimiting the recess, at least in sections forms a cutter.

9. A submersible pump according to claim 8, wherein the cutter is formed on an edge section of the recess which faces a rotation direction of the impeller.

10. A submersible pump according to claim 8, wherein the section forming the cutter is aligned at an angle of 15 to 90° with respect to the outer end-side of the sealing ring.

11. A submersible pump according to claim 8, wherein an edge section of the recess which is arranged lying opposite the cutter is aligned at an angle of 15 to 90° with respect to the outer end-side of the sealing ring.

12. A submersible pump comprising:

a pump housing including a pump housing stationary part;

an impeller arranged in said pump housing; and a seal sealing the impeller with respect to said pump housing stationary part said seal comprises an impeller side sealing ring arranged on an impeller side and engaging a pump-housing-side sealing ring arranged on a pump housing side, said pump-housing-side sealing ring comprising a recess leading solid matter particles away and said impeller-side sealing ring comprise a catcher on an outer side for transporting solid matter particles.

13. A submersible pump according to claim 12, wherein said seal is arranged at an end of said impeller which said end of said impeller being spaced apart axially distanced from a suction port of said pump.

14. A submersible pump according to claim 12, wherein:

said impeller-side sealing ring has a hollow-cylindrical shape; and said pump-housing-side sealing ring has a hollow-cylindrical shape.

15. A submersible pump according to claim 14, wherein said impeller-side sealing ring has an outer periphery comprising a depression, said depression defining at least a portion of said catcher.

16. A submersible pump according to claim 12, wherein said recess is arranged on a section of said sealing ring which faces a low-pressure region of said pump housing, said depression being defined by a circumferential surface of said impeller-side sealing ring, said circumferential surface extending continuously, with interruption, wherein said depression is open on only one side thereof.

17. A submersible pump according to claim 12, wherein said recess is formed on an axial outer edge of said sealing ring.

18. A submersible pump according to claim 12, wherein an edge delimiting said recess, at least in sections forms a cutter.

19. A submersible pump according to claim 18, wherein said cutter is formed on an edge section of said recess which faces a rotation direction of said impeller.

20. A submersible pump according to claim 18, wherein said section forming said cutter is aligned at an angle of 15 to 90° with respect to said outer end-side of said sealing ring.

* * * * *